US010786029B2

(12) United States Patent
Lombard

(10) Patent No.: US 10,786,029 B2
(45) Date of Patent: Sep. 29, 2020

(54) HELMET LIGHTING SYSTEM

(71) Applicant: Vernon Lombard, New Orleans, LA (US)

(72) Inventor: Vernon Lombard, New Orleans, LA (US)

( * ) Notice: Subject to any disclaimer, the term of this patent is extended or adjusted under 35 U.S.C. 154(b) by 0 days.

(21) Appl. No.: 16/054,168

(22) Filed: Aug. 3, 2018

(65) Prior Publication Data

US 2019/0090570 A1 Mar. 28, 2019

Related U.S. Application Data

(63) Continuation of application No. 15/207,757, filed on Jul. 12, 2016, now Pat. No. 10,039,336, which is a (Continued)

(51) Int. Cl.
*A42B 3/04* (2006.01)
*F21V 21/084* (2006.01)

(Continued)

(52) U.S. Cl.
CPC ..... *A42B 3/044* (2013.01); *F21V 21/084* (2013.01); *F21V 23/006* (2013.01); *F21V 23/04* (2013.01);

(Continued)

(58) Field of Classification Search
CPC ..... A42B 3/044; A42B 3/0446; A42B 3/0453; F21V 21/084; F21V 23/003;

(Continued)

(56) References Cited

U.S. PATENT DOCUMENTS 4,231,079 A 10/1980 Heminover
4,521,831 A * 6/1985 Thayer ..... A42B 3/044 2/422

(Continued)

OTHER PUBLICATIONS

International Search Report; Application No. PCT/US2011/062243; dated Nov. 28, 2011.

(Continued)

*Primary Examiner* — Alan B Cariaso
(74) *Attorney, Agent, or Firm* — Knobbe, Martens, Olson & Bear LLP

(57) ABSTRACT

A helmet including a lighting system integrated into said helmet, the lighting system comprising a first layer; light emitting means mounted to said first layer; controller means mounted to said first layer for controlling said light emitting means; wiring means for linking said light emitting means to said controller means; a second layer fixably attached to said first layer thereby providing an area between said first and second layer for said light emitting means, controller means, and wiring means; power means fixably attached to said second layer for powering said controller and light emitting means; and operating means functionally linked to said controller means for operating said controller means. The application also discloses lighting system contained in a shell that that can be attached to an existing helmet. This application also discloses a lighting system contained in a flexible material that can be fitted onto an existing helmet.

5 Claims, 10 Drawing Sheets

Related U.S. Application Data continuation of application No. 14/106,561, filed on Dec. 13, 2013, now Pat. No. 9,392,832, which is a continuation of application No. 13/486,324, filed on Jun. 1, 2012, now Pat. No. 8,608,333, which is a continuation of application No. 12/955,719, filed on Nov. 29, 2010, now Pat. No. 8,192,043, which is a continuation-in-part of application No. 11/687,177, filed on Mar. 16, 2007, now Pat. No. 7,845,816, which is a continuation-in-part of application No. 11/538,136, filed on Oct. 3, 2006, now abandoned.

(51) Int. Cl.

| | |
|---|---|
| ***F21V 23/00*** | (2015.01) |
| ***F21V 23/02*** | (2006.01) |
| ***F21Y 115/10*** | (2016.01) |
| ***F21V 23/04*** | (2006.01) |

(52) U.S. Cl.
CPC ..... *F21V 23/0435* (2013.01); *F21V 23/023* (2013.01); *F21Y 2115/10* (2016.08)

(58) Field of Classification Search
CPC .... F21V 23/004; F21V 23/005; F21V 23/006; F21V 23/023; F21V 23/0435; F21V 23/04
See application file for complete search history.

(56) References Cited

U.S. PATENT DOCUMENTS

| | | | | |
|---|---|---|---|---|
| 4,891,736 | A | 1/1990 | Gouda | |
| 4,956,752 | A | 9/1990 | Foglietti | |
| 5,040,099 | A | 8/1991 | Harris | |
| 5,327,587 | A | 7/1994 | Hurwitz | |
| 5,353,008 | A | 10/1994 | Eikenberry et al. | |
| 5,357,409 | A | 10/1994 | Glatt | |
| 5,416,675 | A | 5/1995 | DeBeaux | |
| 5,426,792 | A | 6/1995 | Murasko | |
| 5,438,494 | A * | 8/1995 | Harlan | A42B 1/244 24/3.9 |
| 5,477,209 | A | 12/1995 | Benson, Jr. et al. | |
| 5,479,325 | A | 12/1995 | Chien | |
| 5,485,358 | A | 1/1996 | Chien | |
| 5,564,128 | A | 10/1996 | Richardson | |
| 5,570,946 | A | 11/1996 | Chien | |
| 5,688,039 | A * | 11/1997 | Johnson | A42B 3/0446 362/106 |
| 5,758,947 | A * | 6/1998 | Glatt | A42B 3/044 362/105 |
| 5,810,467 | A | 9/1998 | Hurwitz | |
| 5,871,271 | A | 2/1999 | Chien | |
| 5,910,764 | A | 6/1999 | Hayden | |
| 5,931,559 | A | 8/1999 | Pfaeffle | |
| 6,007,213 | A | 12/1999 | Baumgartner | |
| 6,101,636 | A | 8/2000 | Williams | |
| 6,159,324 | A | 12/2000 | Watters et al. | |
| 6,244,721 | B1 | 6/2001 | Rodriquez et al. | |
| 6,325,521 | B1 | 12/2001 | Gregg et al. | |
| 6,328,454 | B1 | 12/2001 | Davis | |
| 6,348,859 | B1 | 2/2002 | Baker | |
| 6,406,168 | B1 | 6/2002 | Whiting | |
| 6,499,145 | B1 | 12/2002 | Kates | |
| 6,529,126 | B1 | 3/2003 | Henry | |
| 6,529,128 | B2 | 3/2003 | Henry | |
| 6,532,602 | B2 | 3/2003 | Watters et al. | |
| 6,686,837 | B2 | 2/2004 | Kim | |
| 6,720,870 | B2 | 4/2004 | Morse | |
| 6,752,510 | B1 | 6/2004 | Appiah | |
| 6,784,795 | B1 | 8/2004 | Pories et al. | |
| 6,933,839 | B2 | 8/2005 | Henry | |
| 6,935,761 | B2 | 8/2005 | Vanderschuit | |
| 7,111,956 | B2 | 9/2006 | Brown | |
| 7,121,076 | B2 | 10/2006 | Priegelmeir et al. | |
| 7,121,676 | B1 | 10/2006 | Kutnyak | |
| 7,311,413 | B1 * | 12/2007 | Barnes | A42B 3/044 362/106 |
| 7,425,082 | B1 * | 9/2008 | Jones | A42B 3/044 362/269 |
| 7,841,026 | B2 * | 11/2010 | Makris | A42B 3/0433 2/424 |
| 8,192,043 | B2 | 6/2012 | Lombard | |
| 8,608,333 | B2 | 12/2013 | Lombard | |
| 10,039,336 | B2 * | 8/2018 | Lombard | A42B 3/044 |
| 2003/0137413 | A1 | 7/2003 | Morse | |
| 2003/0231109 | A1 | 12/2003 | Kim | |
| 2004/0008106 | A1 | 1/2004 | Konczai | |
| 2004/0052068 | A1 * | 3/2004 | Chien | A42B 3/044 362/105 |
| 2004/0227628 | A1 | 11/2004 | Burdick | |
| 2004/0264173 | A1 * | 12/2004 | Vanderschuit | A42B 1/062 362/103 |
| 2005/0134439 | A1 | 6/2005 | Moore et al. | |
| 2008/0080171 | A1 | 4/2008 | Lombard | |
| 2016/0360817 | A1 | 12/2016 | Lombard | |

OTHER PUBLICATIONS

International Search Report; Application No. PCT/US2011/062243; dated Jul. 10, 2012 in 8 pages.

* cited by examiner

HELMET LIGHTING SYSTEM

INCORPORATION BY REFERENCE TO RELATED APPLICATIONS

Any and all priority applications identified in the Application Data Sheet, or any correction thereto, are hereby incorporated by reference herein and made a part of the present disclosure.

BACKGROUND OF THE INVENTION

This application relates generally to a helmet lighting system. More specifically, this application discloses a lighting system that can be integrated into a helmet and a lighting system for attachment to an existing helmet.

SUMMARY OF THE INVENTION

This application discloses an integrated helmet lighting system for providing a helmet with a light source. The system is of simple construction and can be used in a variety of applications including helmets used by law enforcement, the military, the coast guard, firemen, civilian motorcycle riders, bicycle riders and any other individual that would benefit from the use of wearing a helmet that includes a light source. Such benefits include, but are not limited to, enhancing the wearer's visibility, signaling, and the simple enjoyment of using a light source integrated to a helmet to convey a personal design or message.

In particular, this application discloses a helmet including a lighting system integrated into said helmet, the lighting system comprising a first layer; light emitting means mounted to said first layer; controller means mounted to said first layer for controlling said light emitting means; wiring means for linking said light emitting means to said controller means; a second layer fixably attached to said first layer thereby providing an area between said first and second layer for said light emitting means, controller means, and wiring means; power means fixably attached to said second layer for powering said controller and light emitting means; and operating means functionally linked to said controller means for operating said controller means.

This application also discloses a helmet lighting system for attachment to an existing helmet, the system comprising a first layer; light emitting means mounted to said first layer; controller means mounted to said first layer for controlling said light emitting means; wiring means for linking said light emitting means to said controller means; a second layer fixably attached to said first layer thereby providing an area between said first and second layer for said light emitting means, controller means, and wiring means; power means fixably attached to said second layer for powering said controller and light emitting means; operating means functionally linked to said controller means for operating said controller means; and attachment means for attachment of said lighting system to the exterior surface of said existing helmet.

This application further discloses a helmet including a lighting system integrated into said helmet, the lighting system comprising a first layer; light emitting diodes mounted to said first layer; a circuit board mounted to said first layer for controlling said light emitting diodes; wires for linking said light emitting diodes to said circuit board; a second layer fixably attached to said first layer thereby providing an area between said first and second layer for said light emitting diodes, circuit board, and wires; power means fixably attached to said second layer for powering said circuit board and light emitting diodes; and operating means functionally linked to said circuit board for operating said controller means.

This application also discloses a flexible helmet lighting system composed of latex or other similar material that can be fitted over an existing helmet, the system comprising a first layer; light emitting means mounted to said first layer; controller means mounted to said first layer for controlling said light emitting means; wiring means for linking said light emitting means to said controller means; a second layer fixably attached to said first layer thereby providing an area between said first and second layer for said light emitting means, controller means, and wiring means; power means fixably attached to said second layer for powering said controller and light emitting means; operating means functionally linked to said controller means for operating said controller means; and fitted means for fitting of said flexible lighting system to the exterior surface of said existing helmet.

BRIEF DESCRIPTION OF THE DRAWINGS

The drawings, when considered in connection with the following description, are presented for the purpose of facilitating an understanding of the subject matter sought to be protected.

DETAILED DESCRIPTION OF THE PREFERRED EMBODIMENTS

Figure 9:
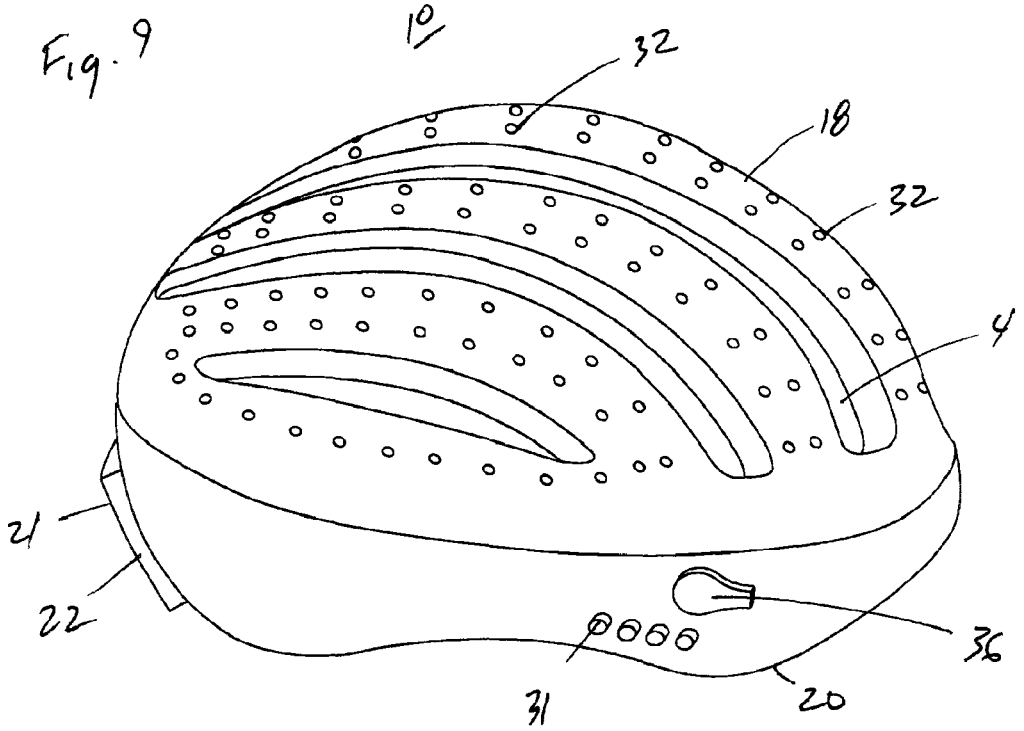
FIG. 9 is a perspective view of the first embodiment of the helmet lighting system disclosed herein incorporated into a bicycle helmet.
Figure 10:
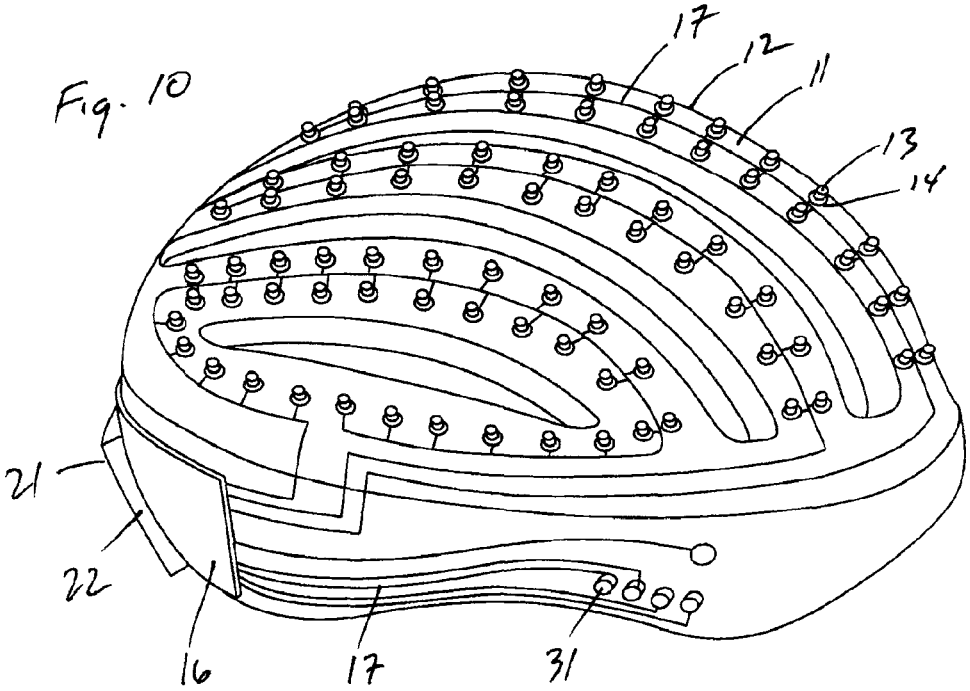
FIG. 10 is a perspective view of the helmet shown in FIG. 9 with the external layer removed to show the internal features.
Figure 11:
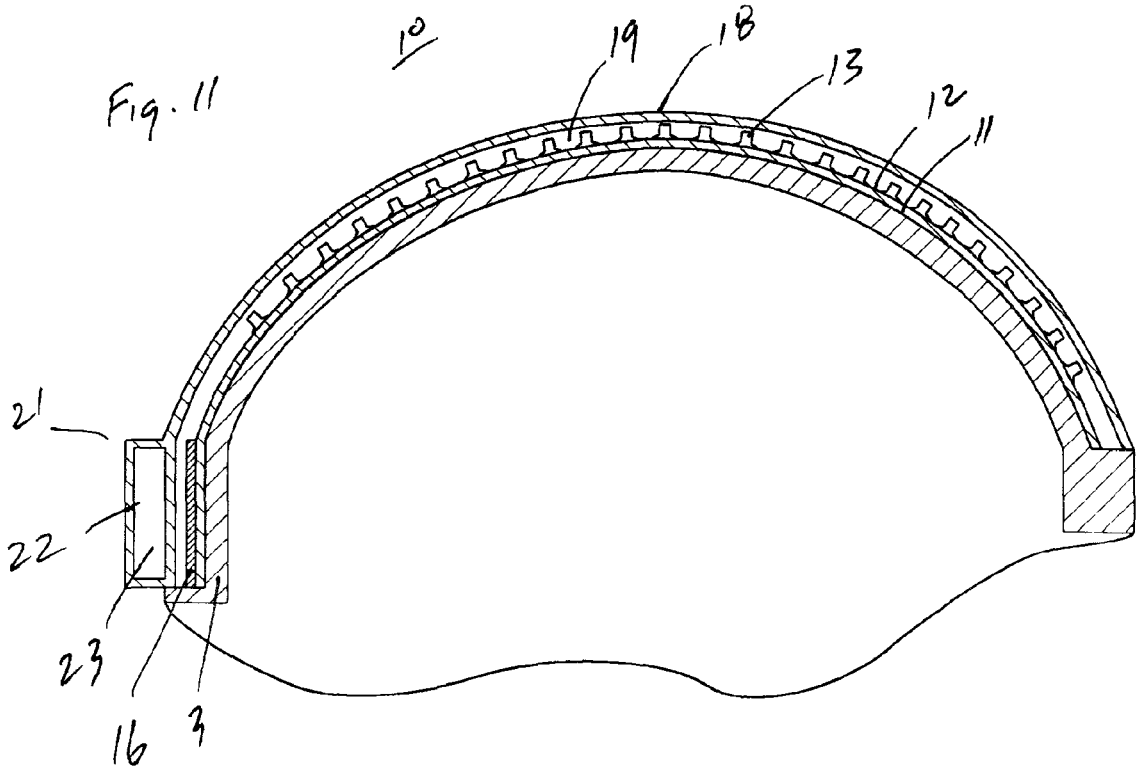
FIG. 11 is cross-section view of the helmet shown in FIG. 9.
Figure 12:
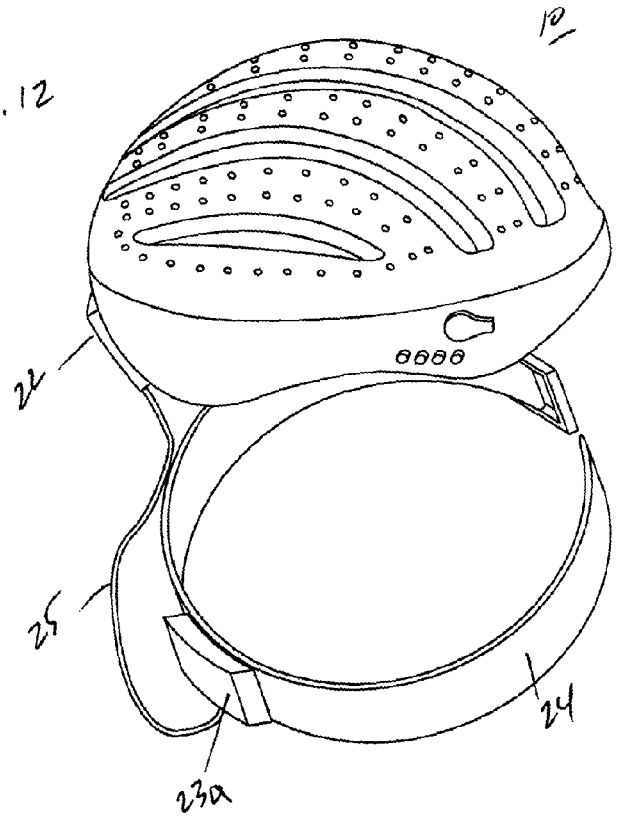
FIG. 12 is a perspective view of the helmet in FIG. 9 shown with a first embodiment of an indirect power supply.
Figure 13:
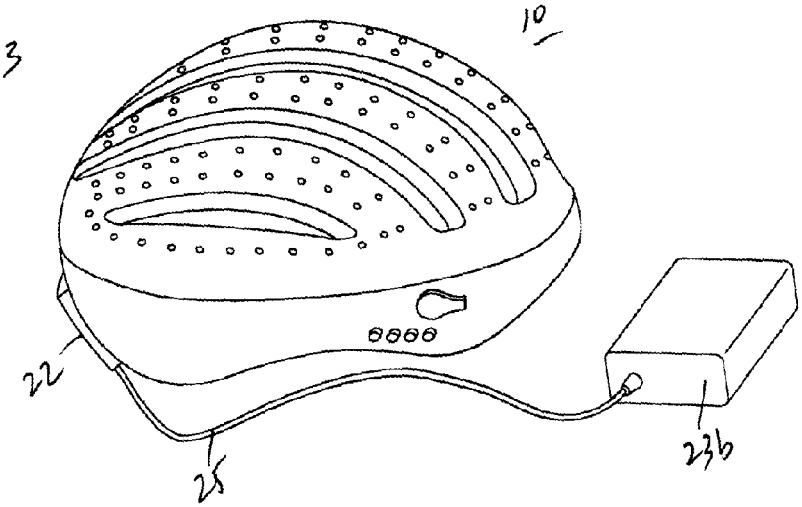
FIG. 13 is a perspective view of the helmet in FIG. 9 shown with a second embodiment of an indirect power supply.

Referring to FIGS. 1-3 and 4-6, and shown therein and generally designated by the reference character 10 is the first and second embodiment respectively of the helmet lighting system 10 constructed in accordance with the following description. For simplification of the following description, the various embodiments of the helmet lighting system herein can be generally described as falling into either an all-in-one design or a shell design or a pin and bore assembly. The first embodiment of the helmet lighting system 10 is an example of an all-in-one design and the second embodiment is an example of a shell design for attachment to an existing helmet. FIGS. 9-11 show an example of the first embodiment (all-in-one) incorporated in a bicycle helmet. The two embodiments are shown incorporated in a motorcycle helmet (FIGS. 1-6) and a bicycle helmet (FIGS. 9-11); however, it should be appreciated that the two embodiments of the helmet lighting system may be incorporated into a variety of helmets, including, but not limited to, a police helmet, a fireman helmet, a coast guard helmet, a military helmet, a snowboard or skiing helmet, a football helmet, a hockey helmet or any other helmet type device used worn on the head. Regardless of the nature of the helmet device 1, which are well known in the art, and shown for example purposes only, each is generally characterized by having an outer shell 2, inner padding 3, ventilation inlets 4, and retaining means such as a chin strap (not shown).

Figure 1:
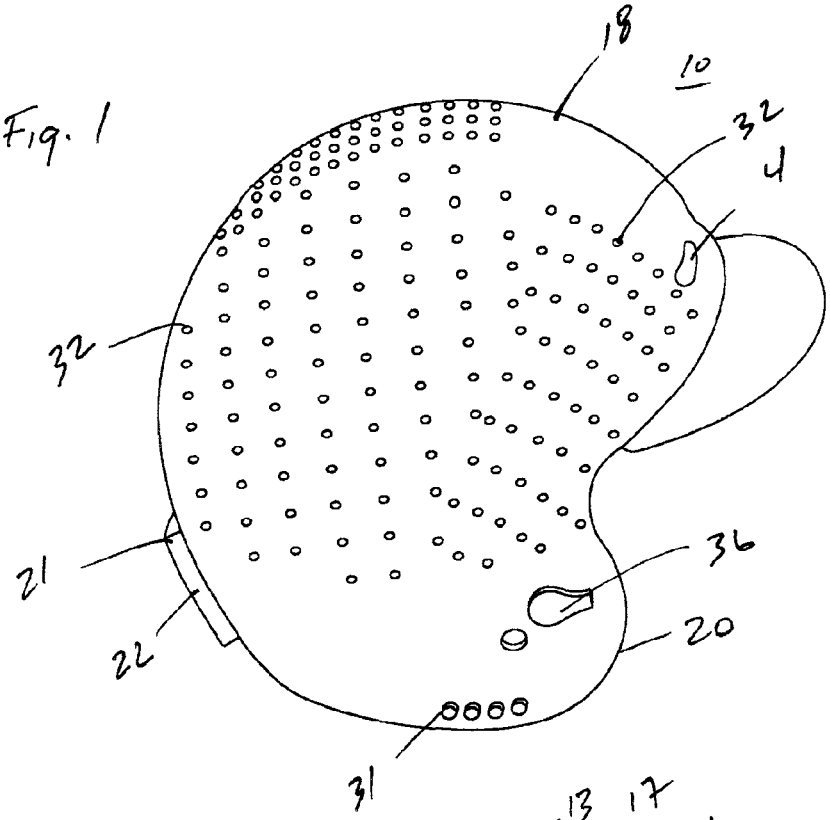
FIG. 1 is a perspective view of a first embodiment of the helmet lighting system disclosed herein incorporated into a helmet.
Figure 2:
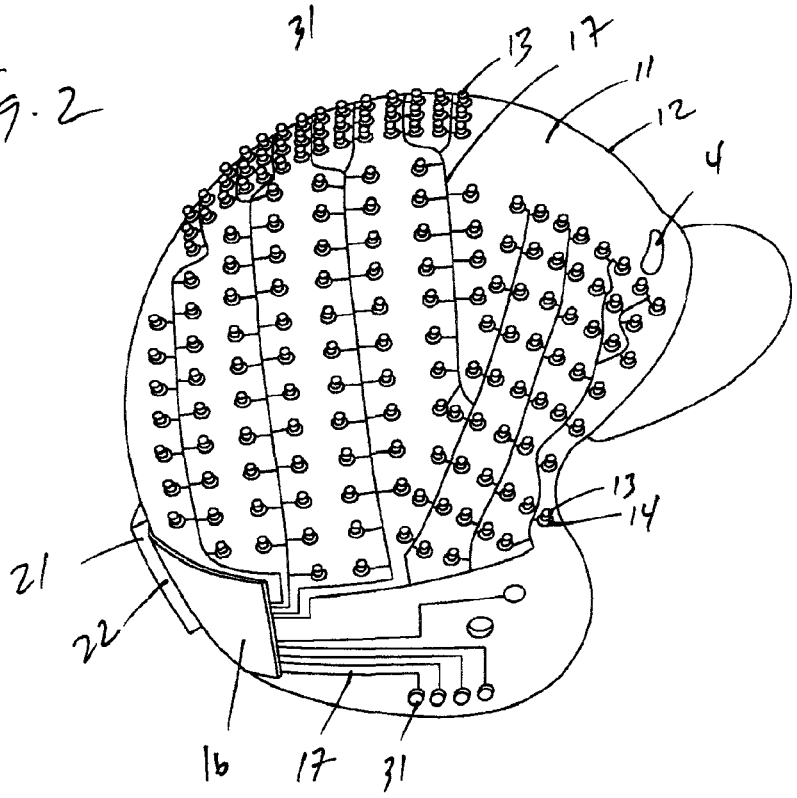
FIG. 2 is a perspective view of the helmet shown in FIG. 1 with the external layer removed to show the internal features.
Figure 3:
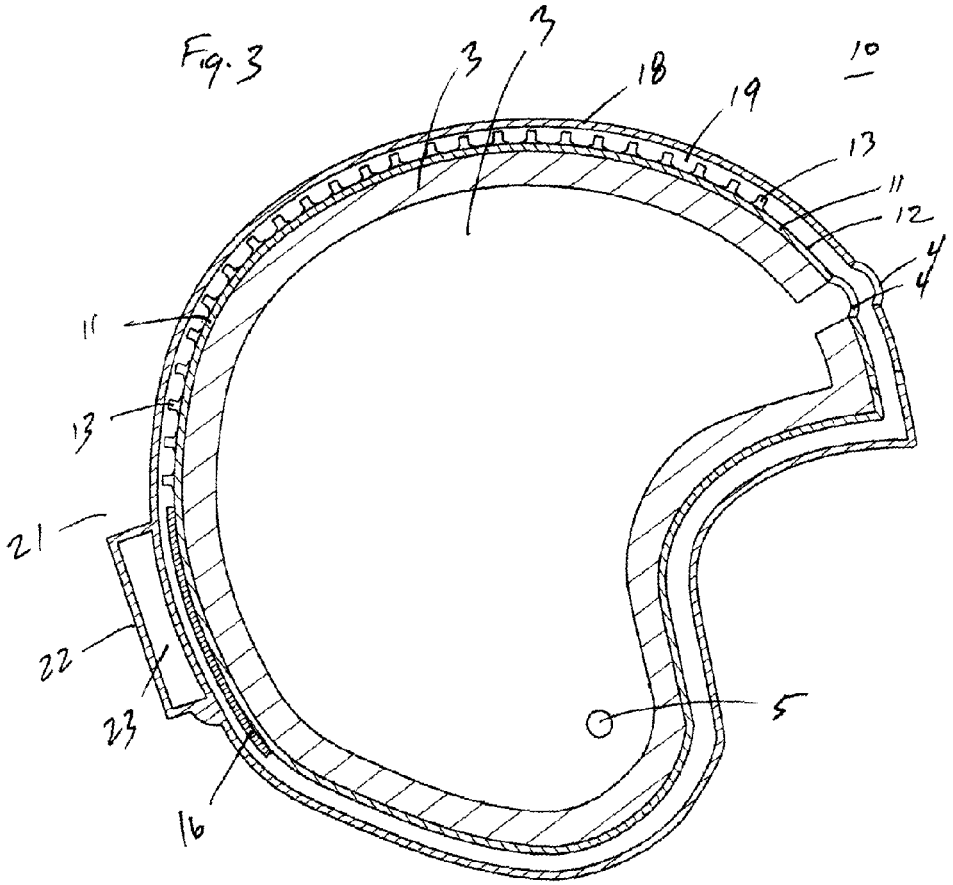
FIG. 3 is cross-section view of the helmet shown in FIG. 1.
Figure 4:
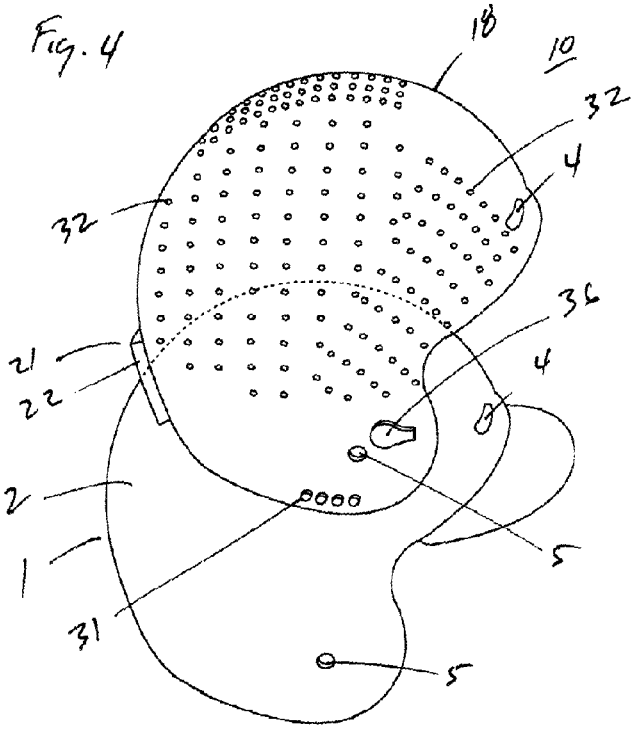
FIG. 4 is a perspective view of a second embodiment of the helmet lighting system disclosed herein incorporated into a shell for attachment to an existing helmet.
Figure 5:
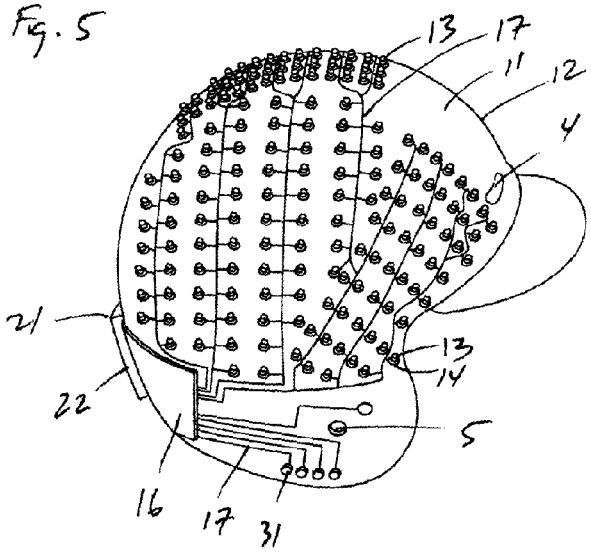
FIG. 5 is a perspective view of the helmet shown in FIG. 4 with the external layer removed to show the internal features.
Figure 6:
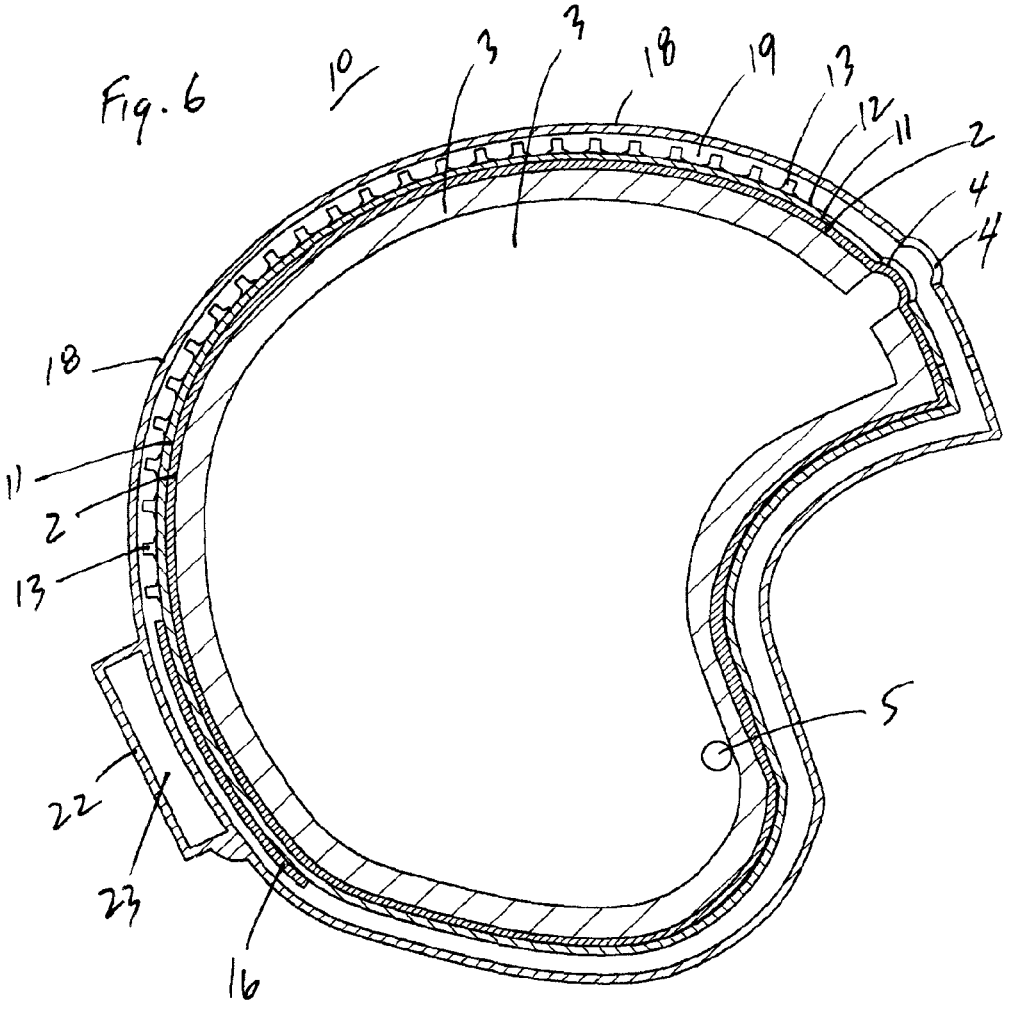
FIG. 6 is cross-section view of the helmet shown in FIG. 4.

Referring now to FIGS. 1-3, a first embodiment of the helmet lighting system 10 is shown wherein the system is integrated into a helmet (all-in-one). The lighting system includes a first layer 11 made of a moldable plastic type material, but may include carbon fiber or similar crash resistant material. Preferably, the first layer may be made of polycarbonate. The first layer includes an outer surface 12 to which a light emitting means is bonded to. Preferably the light emitting means is a light emitting diode (LED) 13 that is of high brightness such as the type manufactured by Nichia America Corporation. The LEDs include a base 14 that allows them to be individually bonded to the outer surface 12 of the first layer. Preferably the LEDs 13 are bonded using a urethane aerospace epoxy.

A controller means is mounted to the first layer as well using the above epoxy and is used to control the duration, intensity, and sequence of the LEDs 13. Preferably the controller means is a an ultra low power circuit board 16 such as a 16.times.684 microcontroller chip which uses high efficiency, low on resistance field effect transistors to drive the LEDs 13. In such a configuration, the LEDs 13, even when left on continuously, generate little to no heat. Wiring means are then used for linking the LEDs 13 to the circuit board 16. Preferably low resistance wires 17 are used, which are well known in the art.

Figure 7:
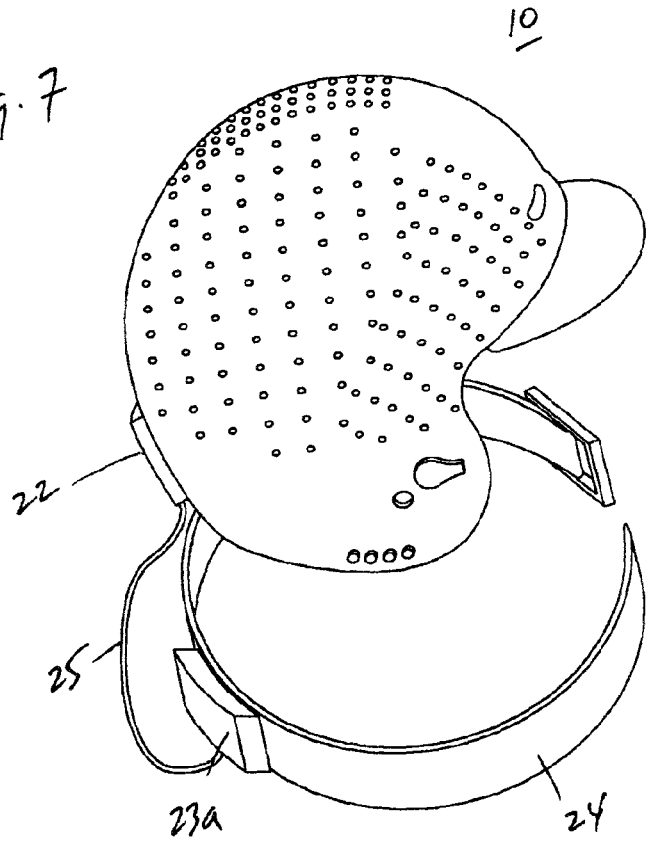
FIG. 7 is a perspective view of the helmets in FIGS. 1 and 4 shown with a first embodiment of an indirect power supply.
Figure 8:
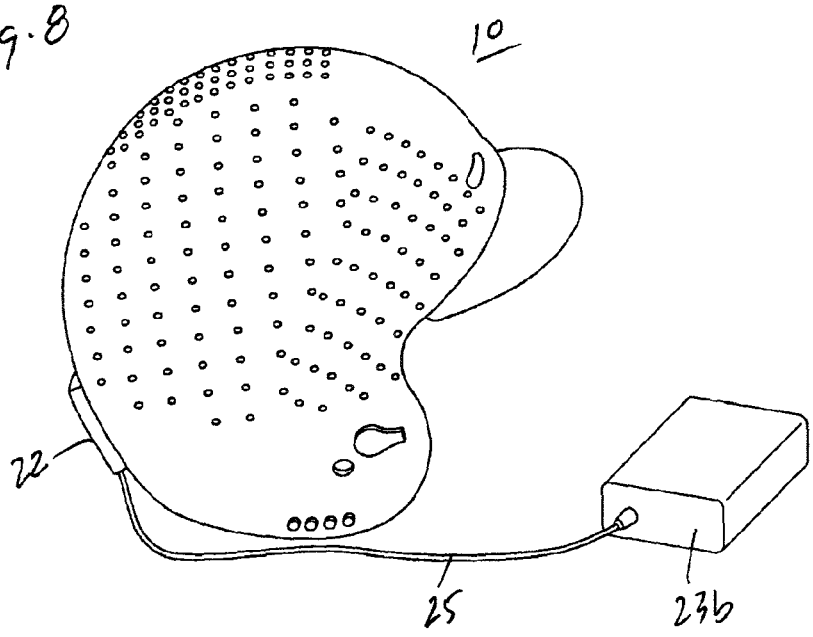
FIG. 8 is a perspective view of the helmets in FIGS. 1 and 4 shown with a second embodiment of an indirect power supply.
Figure 16:
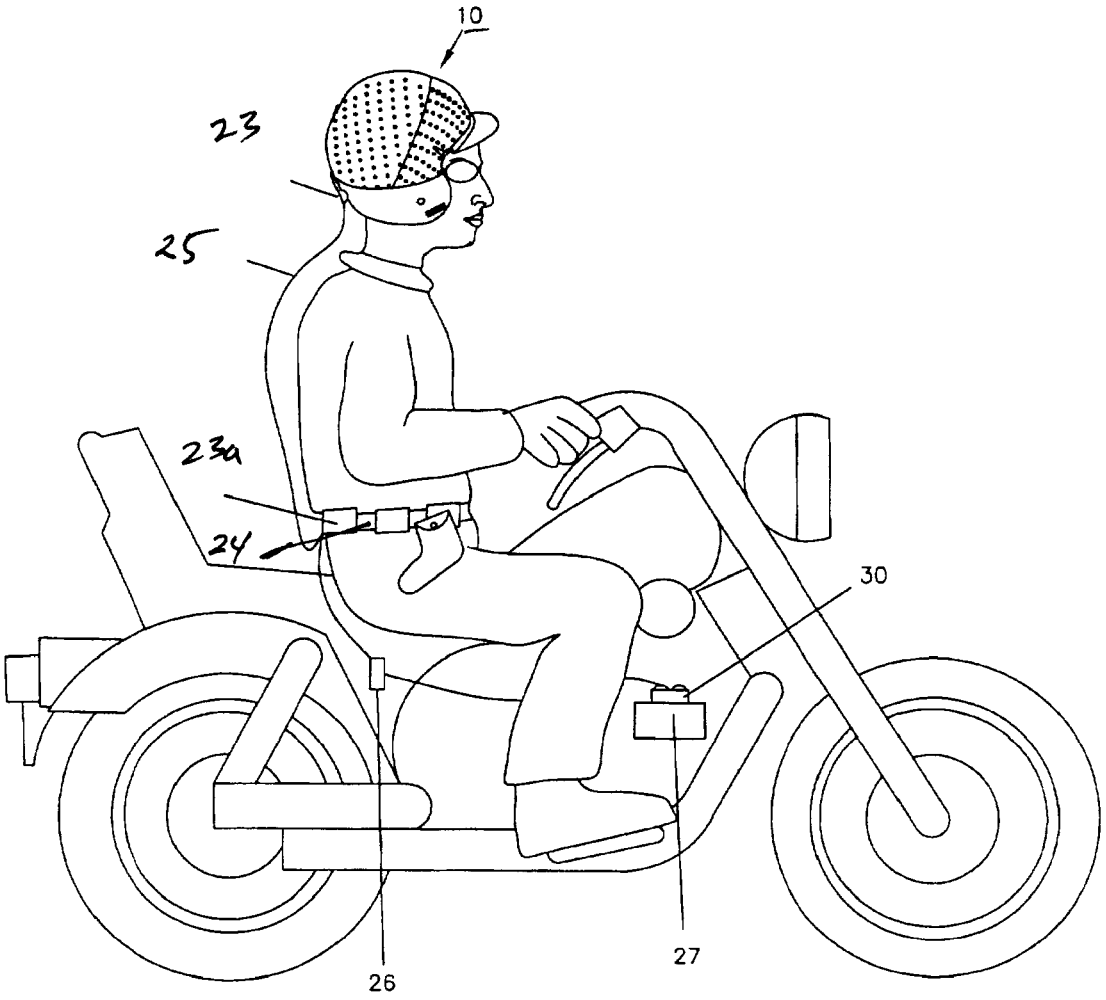
FIG. 16 is perspective view of the first and second embodiment of the helmet lighting system of FIGS. 1 and 4, shown on the head of a motorcyclist.

A second layer 18 is then fixably attached to the first layer 11 thereby providing an area 19 between the first 11 and second layer 18. The second layer is also made from a moldable crash resistant plastic material, but is preferably made of a transparent material such as polycarbonate so that the LEDs 13 are visible when activated by the circuit board 16. Preferably the second layer 18 is bonded to the first layer about its edges 20 using an epoxy or any other similar means so as to create a waterproof seal. A power source 21 is then fixedly attached to the second layer 18 for powering the circuit board 16 and the LEDs 13 again using a suitable epoxy that provides a waterproof seal. The powering means may be of two general types. The first type is a direct powering means such a battery compartment 22 which can house standard batteries, or preferably, a lightweight, high power 2.6 amp 14.8 volt Lithium-ion rechargeable battery pack 23. Alternatively, the helmet lighting system may employ a second type of powering means, an indirect powering means, as shown in FIGS. 7 and 8, whereby a battery pack 23*a*, linked by an adapter 25 to the battery compartment 22, is mounted to a belt 24 (FIG. 7) or the battery pack 23*b* is alone (FIG. 8) and linked to the battery compartment 22 by an adapter 25 and thereby capable of being mounted to the particular device the rider is utilizing. In these examples, the weight of the helmet is lessened by taking advantage of the indirect power source. Additionally, power for the helmet lighting system, in the case of a motorized vehicle, can be supplied by the motor vehicles existing battery or an additional dedicated battery mounted thereto. For example in FIG. 16, the lighting system 10 may also be charged though an adapter 25 which can be plugged into the utility belt 24 of the user. Once plugged in, the direct battery pack 23 can be charged or the lighting system 10 in the helmet can be run by the power from the utility belt 24 with the mounted battery pack 23*a*. The direct mounted battery pack battery pack 23 may also be charged through a spring loaded extension 26 located under the seat of the motorcycle. This apparatus will be connected to an adapter 30 on the motorcycle's battery 27. The battery pack 23 from the helmet can then be connected to the spring loaded extension 26 through the utility belt 24 of the user. When the battery pack 23 is connected in this manner it can be charged through the motorcycle's battery 27 or other dedicated battery and have an unlimited source of power while connected to the motorcycle.

Operating means are then functionally linked to the circuit board 16 for its operation. Preferably the operating means include buttons 31 that can be mounted to the second layer 18. The buttons 31 can be programmed to elicit different flashing programs contained within the circuit board 16. Alternatively, the operating means may include wireless activation as is common in the art through the use of a remote control (not shown). Further, the operating means may be employed by linking the circuit board 16 to the device that is being ridden by use of a common adapter such that the signaling mechanisms of the device (stop, left turn, right turn, etc.) are directly transmitted to the circuit board 16 and the appropriate signal is displayed to the LEDs 13 contained in the helmet lighting system 10.

Figure 14:
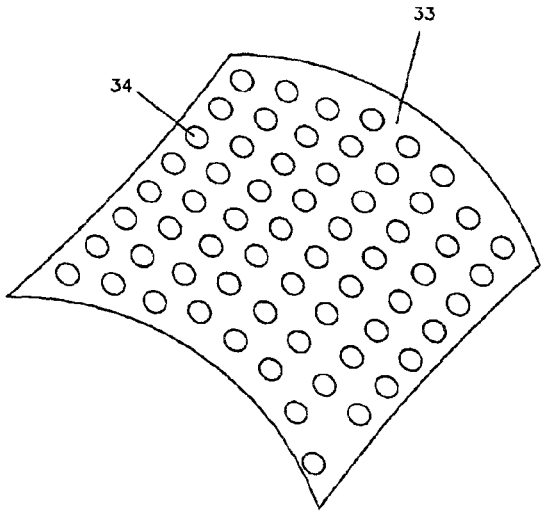
FIG. 14 is a perspective view of a perforated film cover.
Figure 15:
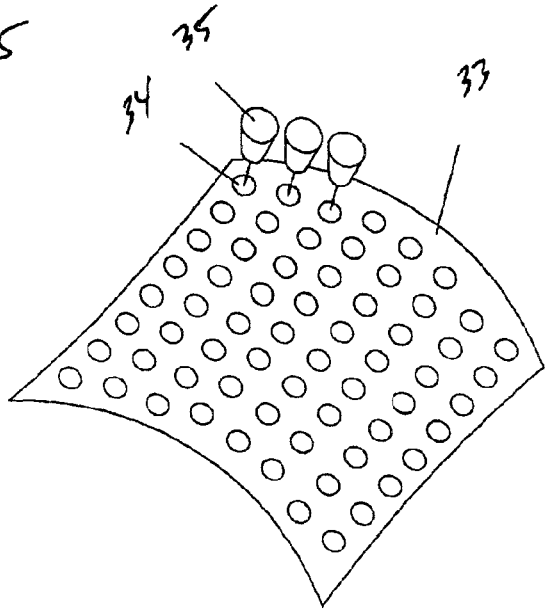
FIG. 15 is a perspective view of a second embodiment of the perforated film cover in FIG. 14.

Once the lighting system is fully assembled, the transparent second layer 18 can be painted. Areas 32 above the LEDs 13 are protected with a masking type device so that once the second layer is painted, the masking is removed and the LEDs 13 are able to shine through the unpainted transparent areas 32. Alternatively, the second layer 18 may be painted in advance with the proper window pattern for a given application and then simply assembled as described above. Likewise, a perforated film cover 33 can be placed over the second layer 18 with an adhesive such that window portions 34 are positioned over the location of the LEDs 13 mounted underneath. See FIG. 14. Given the LEDs 13 used, and the overall structure of the assembled lighting system 10 described above, the daylight visibility is at least 150 feet and night time visibility is at least one mile. If further visibility is desired, the windows portions 34 of the perforated film cover 33 may be filled with a magnifying plastic material 35 that will act to increase the LEDs' visibility. See FIG. 15.

The helmet lighting system 10 may also include at least one light emitting means mounted on the exterior surface of the second layer. Preferably this light emitting means is at least one LED housed within a pivoting retainer 36 so that the user can direct light in a variety of directions. It is preferred to have at least one pivoting LED retainer 36 on each side of the helmet and the range of motion of the retainer 36 is approximately 45 degrees. The pivoting light retainer 36 is functionally linked to the controller means, power means, and operating means as described above for the first layer 11 mounted LEDs 13.

In addition to the above features related to the helmet lighting system 10, the helmet may also feature a musical chip such as an mp3 player (not shown) that is capable of storing and playing music while the lighting system is functioning. The chips can play previously stored songs or additional songs that can be downloaded onto the chips. Music can be heard either through a speaker or a headphone jack. Such a musical chip is well known in the art. Further, the helmet lighting system 10 may include a motion sensor, such that when the helmet is left unattended and the sensor is activated, an alarm will sound if the helmet is moved in any way. The helmet may also include ventilation inlets 4 that allow air to flow to the user's head.

Referring now to FIGS. 9-13, the first embodiment of the helmet lighting system 10, as described fully above, is shown integrated into a lightweight helmet (all-in-one), such as for a bicycle rider. As seen in the figures, the overall structure is the same, and only the shapes of the items have changed to accommodate the lightweight helmet design. As also seen in the figures, all of the features listed above for the previous helmet design are present in the lightweight helmet shown here.

Referring now to FIGS. 4-8, a second embodiment of the helmet lighting system 10 is shown. The second embodiment is an example of a shell design for attachment to an existing helmet 1 that includes an outer shell 2, inner padding 3, ventilation inlets 4, and retaining means such as a chin strap (not shown). As seen in the associated figures, in this embodiment the shell is comprised of the same features as described above for the all-in-one design, with the only difference being that first layer 11 is mountable to the outer shell 2 of the existing helmet 1 by use of attachment means, thereby allowing existing helmets to be converted to a helmet with a light source. To aid in the attachment of the first layer 11 to the outer shell 2 of the existing helmet 1, it is preferred to vacuum form the desired plastic like material, such as polycarbonate to the outer shell 2 to ensure that a proper fit is obtained. Once the proper shape of the first layer 11 is obtained, the lighting system 10 is built up the same way as described above, thereby resulting in a shell that can be now attached to an existing helmet 1 and secured with the appropriate attachment means. Potential attachment means include, sonic welding, adhesive, screws and any other means of binding two like material together. Preferably the shell is attached by utilizing the existing helmets hardware such as rivets that are used to secure the chin strap to the helmet 1. The rivets are removed from the bores 5 located on each side of the helmet 1, the shell is placed on the outer shell 2, and the rivets are reinserted into the bores 5 to secure the shell upon the helmet 1. Further, the shell is preferably formed such that it incorporates the same ventilation inlets 4 as found in the existing helmet so to not impede air flow to the user.

A third embodiment of the invention is a flexible helmet lighting system composed of latex or other similar material fitting over an existing helmet 1 that includes an outer shell 2, inner padding 3, ventilation inlets 4, and retaining means such as a chin strap (not shown). In this embodiment the flexible helmet lighting system is comprised of the same features as described above for the shell design, with the only difference being that first layer 11 is mountable to the outer shell 2 of the existing helmet 1 by use of fitting means, thereby allowing existing helmets to be converted to a helmet with a light source. To aid in the fitting of the first layer 11 to the outer shell 2 of the existing helmet 1, it is preferred compose the system of flexible material, such as latex or rubber to ensure that a proper fit is obtained and to also allow the flexible helmet lighting system to be inflatable and float. A strap or cord which can be pulled is included to tighten around the base to also ensure that a proper fit is obtained. Once the proper shape of the first layer 11 is obtained, the lighting system 10 is built up the same way as described above, thereby resulting in a flexible system that can be now fitted onto an existing helmet 1 and secured with the appropriate attachment means. Potential attachment means include, another strap or cord and a Velcro attachment.

While the present disclosure has been described in connection with what is considered the most practical and preferred embodiment, it is understood that this disclosure is not limited to the disclosed embodiments, but is intended to cover various arrangements included within the spirit and scope of the broadest interpretation so as to encompass all such modifications and equivalent arrangements. For example, it is contemplated that the light emitting means may further include a light bar, light strip or any other light emitting means. It is further contemplated that, regardless of the light emitting means used, they can be arranged in an infinite amount of ways, utilize an infinite amount of colors, and fire in an infinite amount of patterns and would still fall within the scope of the broadest interpretation of this disclosure.

What is claimed is:

1. A helmet incorporating a lighting system comprising:

a first layer;

a first pivoting retainer and a second pivoting retainer, each mounted to the first layer on opposing sides of the helmet, wherein each of the first pivoting retainer and the second pivoting retainer is pivotally movable independently of the other;

at least one light emitting diode mounted to each of the first pivoting retainer and the second pivoting retainer such that a user can direct light in a variety of directions by adjusting a position of each of the first pivoting retainer and the second pivoting retainer;

a circuit board for controlling the at least one light emitting diode functionally linked to the at least one light emitting diode;

a second layer fixedly attached to the first layer thereby providing a space between the first and second layer for the circuit board;

a power source functionally linked to the at least one light emitting diode and the circuit board for powering the at least one light emitting diode and the circuit board;

an operator functionally linked to the circuit board for operating the circuit board.

2. The lighting system of claim 1 wherein each of the first pivoting retainer and the second pivoting retainer has a range of rotation of about 45°.

3. The lighting system of claim 1, wherein each of the first layer and the second layer is formed to cover a top portion, a rear portion and side portions of a head of the user.

4. The lighting system of claim 3, further comprising a plurality of light emitting diodes located in the space between the first layer and the second layer.

5. The lighting system of claim 1, further comprising a plurality of light emitting diodes located in the space between the first layer and the second layer.

* * * * *